US006607063B2

(12) United States Patent
Kuwabara et al.

(10) Patent No.: US 6,607,063 B2
(45) Date of Patent: Aug. 19, 2003

(54) COIN DISCRIMINATING AND DISTRIBUTING MECHANISM

(75) Inventors: Toshitomo Kuwabara, Kiryu (JP); Hideaki Yanagisawa, Tano-gun (JP); Tetsuya Mashimo, Kiryu (JP)

(73) Assignee: Sanden Corporation (JP)

( * ) Notice: Subject to any disclaimer, the term of this patent is extended or adjusted under 35 U.S.C. 154(b) by 50 days.

(21) Appl. No.: 09/858,882

(22) Filed: May 17, 2001

(65) Prior Publication Data

US 2002/0011394 A1 Jan. 31, 2002

(30) Foreign Application Priority Data

May 17, 2000 (JP) ..... 2000-145665

(51) Int. Cl.[7] ..... G07D 3/14; G07D 9/00; G07F 5/20

(52) U.S. Cl. ..... 194/346; 453/3

(58) Field of Search ..... 453/3, 4, 17; 194/346

(56) References Cited

U.S. PATENT DOCUMENTS 3,948,377 A * 4/1976 Hayashi et al. ..... 194/346
4,347,924 A * 9/1982 Hayashi et al. ..... 194/346
4,512,454 A * 4/1985 Schuller et al. ..... 194/346
5,052,538 A * 10/1991 Satoh ..... 453/3
5,092,816 A * 3/1992 Levasseur ..... 453/17
5,112,275 A * 5/1992 Sato ..... 453/17
5,468,181 A * 11/1995 Ishida et al. ..... 453/3
5,564,549 A * 10/1996 Menke et al. ..... 194/346
6,076,649 A * 6/2000 Waldorff, Jr. ..... 194/217

FOREIGN PATENT DOCUMENTS

DE 3830920 * 3/1990
JP 11-288480 10/1999

* cited by examiner

*Primary Examiner*—Eileen D. Lillis
*Assistant Examiner*—Paul T. Chin
(74) *Attorney, Agent, or Firm*—Banner & Witcoff, Ltd.

(57) ABSTRACT

In a coin mechanism to which the present invention is applied, a coin of five hundred yen whose holding is released is distributed by a fifth distributing device to a return passage or a coin containing passage. The coin of five hundred yen distributed by the fifth distributing device is distributed by an eighth distributing device to a coin tube or a coin box. As mentioned above, the coin whose holding is released is distributed to a change outlet, the coin box, or the coin tube at a front stage of entering the coin containing part. Accordingly, it is unnecessary to provide another distributing device at a part of the coin tube like the prior art, and the number of coins to be contained in the coin tube is increased. Furthermore, it is possible to set the number of coins to be contained in the coin tube at a small number.

6 Claims, 8 Drawing Sheets

COIN DISCRIMINATING AND DISTRIBUTING MECHANISM

CROSS-REFERENCE TO RELATED APPLICATION

This application is based upon and claims the benefit of priority from Japanese Patent Application Number 2000-145665, filed May 17, 2000, the entire contents of which are hereby incorporated by reference.

BACKGROUND OF THE INVENTION

1. Field of the Invention

The present invention relates to a coin mechanism used for a vending machine or the like, and particularly, relates to the coin mechanism having a structure in which the coin inserted when buying a product is temporarily held.

2. Description of the Prior Art

Previously, as the coin mechanism used for the vending machine, the coin mechanism is well known, which has such a structure where a coin of the amount of money corresponding to five hundred yen is returned when a customer performs a return operation of the coin after throwing in a coin of five hundred yen.

However, in this coin mechanism, there has been such a problem that the coin of the amount of money corresponding to five hundred yen is returned even in the case when it has wrongly been judged that a forged coin of five hundred yen is specie and therefore, a large damage is received because of the throwing-in of the forged coin of five hundred yen.

Therefore, in order to solve this problem, a coin mechanism described in Japanese Patent Laid-Open No. 11-288480 has been proposed.

The basic structure of this coin mechanism is similar to that of the above described conventional coin mechanism. That is, when a coin is inserted for buying a product, first, whether the coin is specie or a forged coin is judged by a coin discriminating device, and furthermore, when it is judged that the coin is specie, the kind of the coin is also discriminated by this coin discriminating device. Then, the coin judged to be a forged coin by the coin discriminating device is returned to the change outlet, and on the other hand, the coin judged to be specie by the coin discriminating device is contained in the coin tube through the coin passage corresponding to each coin.

This coin mechanism is different from the above described conventional coin mechanism in the action of processing the coin in the case where the customer has inserted a coin of five hundred yen.

That is, in the case where the coin discriminating device judges that the coin is a coin of five hundred yen, a temporary holding device performs the holding action, so that this coin of five hundred yen is held in the coin passage. After that, when the customer performs the operation of buying a product (operation of pressing a product select button), the temporary holding device performs the release action, so that the holding state of the coin of five hundred yen is released. This coin of five hundred yen whose holding has been released rolls toward the first distributing device, and is distributed toward the coin tube for five hundred yen by this first distributing device. On the other hand, when the customer performs the return operation of the coin (operation of rotating the return lever), similarly to the above description, the temporary holding device performs the release operation, so that the holding state of the coin of five hundred yen is released, and the coin of five hundred yen rolls toward the first distributing device. This first distributing device distributes the coin of five hundred yen toward the second distributing device, and furthermore, the second distributing device (distributing device for distributing the coin to the coin box or the change outlet) distributes the coin of five hundred yen toward the change outlet, so that the coin of five hundred yen is returned to the change outlet.

Thus, the latter coin mechanism has such a structure where it returns the coin of five hundred yen inserted by the customer himself to the change outlet when the customer performs the return operation of the coin. As a result of this, even in the case where the coin discriminating device wrongly judges that a forged coin of five hundred yen is specie, the forged coin of five hundred yen returns to the customer as it is, and therefore, there is such a practical effect that the damage received when a forged coin of five hundred yen is inserted is decreased.

By the way, in the latter coin mechanism, when the customer performs the operation of buying a product, all coins of five hundred yen are introduced to the coin tube by the distributing operation of the first distributing device, and therefore, when this coin tube has already been filled, it is necessary to distribute the coin of five hundred yen to the coin box. Accordingly, it is necessary to provide another distributing device on the coin tube side besides the above described first distributing device.

Such another distributing device is usually provided at the upper part in the coin tube, and therefore, there has been such a problem that the number of coins to be contained in the coin tube is decreased. Furthermore, there has been such a problem that the coin tube must be large-sized corresponding to the providing of another distributing device, in order to solve the problem of decreasing of the number of coins to be contained.

Furthermore, it is required that the coin tube for five hundred yen can select either the setting of the number of filling or the setting of a small number. This setting of the number of filling is a setting performed for holding a large number of coins of five hundred yen that are paid as the change in the coin tube. On the other hand, the setting of a small number (for example, four) is a setting performed for decreasing the damage caused by the throwing-in of the forged coin of five hundred yen by reducing the return of the coin of five hundred yen of the large amount of money as much as possible. However, in the latter coin mechanism, the setting of a small number has been impossible since all coins of five hundred yen are introduced to the coin tube.

SUMMARY OF THE INVENTION

It is an object of the present invention to provide a coin mechanism in which the number of coins to be contained in the coin tube can be increased and furthermore, a small number of coins of the coin tube can be set, due to the above described problems of the prior art.

A first invention is a coin mechanism of a vending machine, including: a coin discriminating device for discriminating the kind of a inserted coin; a temporary holding device for temporarily holding a specified coin on a coin passage among coins discriminated by the above described coin discriminating device; a distributing device for distributing the coin held by the above described temporary holding device to a coin containing part or a change outlet; and control means for controlling the above described temporary holding device and the above described distributing device, in which the above described distributing device includes an upper distributing device for distributing the coin to a change outlet or a coin containing passage connecting with the above described coin containing part, and a lower distributing device for distributing the coin distributed to the above described coin containing passage to a coin tube or a coin box, and the above described control means can control the above described upper distributing device so that the inserted coin is distributed toward the above described change outlet when a coin return command is given and can control the above described upper distributing device so that the inserted coin is distributed toward the above described coin containing passage when a product buying command is given, and furthermore, the above described control means can control normally the above described lower distributing device so that the inserted coin is distributed toward the above described coin tube and can control the above described lower distributing device so that the inserted coin is distributed toward the above described coin box when a containing prohibition command to the above described coin tube is given.

According to the first invention, the coin whose holding is released from the temporary holding device is distributed to the change outlet, the coin box, or the coin tube at the former stage of entering the coin containing part. That is, it is unnecessary to provide a distributing device at a part of the coin tube like the prior art, and therefore, the number of coins to be contained in the coin tube is increased.

Furthermore, in a case where the number of coins to be contained in the coin tube is set to a small number, this setting can be realized by controlling the lower distributing device.

Furthermore, like a second invention, it is also possible that the coin to be temporarily held is a coin of five hundred yen that is the largest amount of money among the coins to be inserted the vending machine.

Furthermore, in the case where the coin mechanism is mounted to a vending machine on which no bill varidator is mounted, the coin of five hundred yen is unnecessary as the change. At the time of buying a canned drink of the price of one hundred and twenty yen, a case where one coin of five hundred yen is inserted, a case where two coins of one hundred yen are inserted, or a case where one coin of one hundred yen and one coin of fifty yen are inserted are considered, but in any case, it does not occur to use the coin of five hundred yen as the change. Furthermore, in the case a product of the price of five hundred yen or more is purchased, similarly, it does not occur to use the coin of five hundred yen as the change.

In such a case, it is also possible that a coin box containing command switch is provided like the third invention or the fourth invention and all coins of five hundred yen are contained in the coin box.

Furthermore, like the fifth invention or the sixth invention, it is also possible that the control means judges whether there is a bill varidator or not and the lower distributing device is controlled so that the coin of five hundred yen is contained in the coin box when no bill varidator is mounted.

The above described objects, other objects, features, and benefits of the present invention will be apparent by the following description and attached drawings.

DESCRIPTION OF THE PREFERRED EMBODIMENTS

Figure 1:
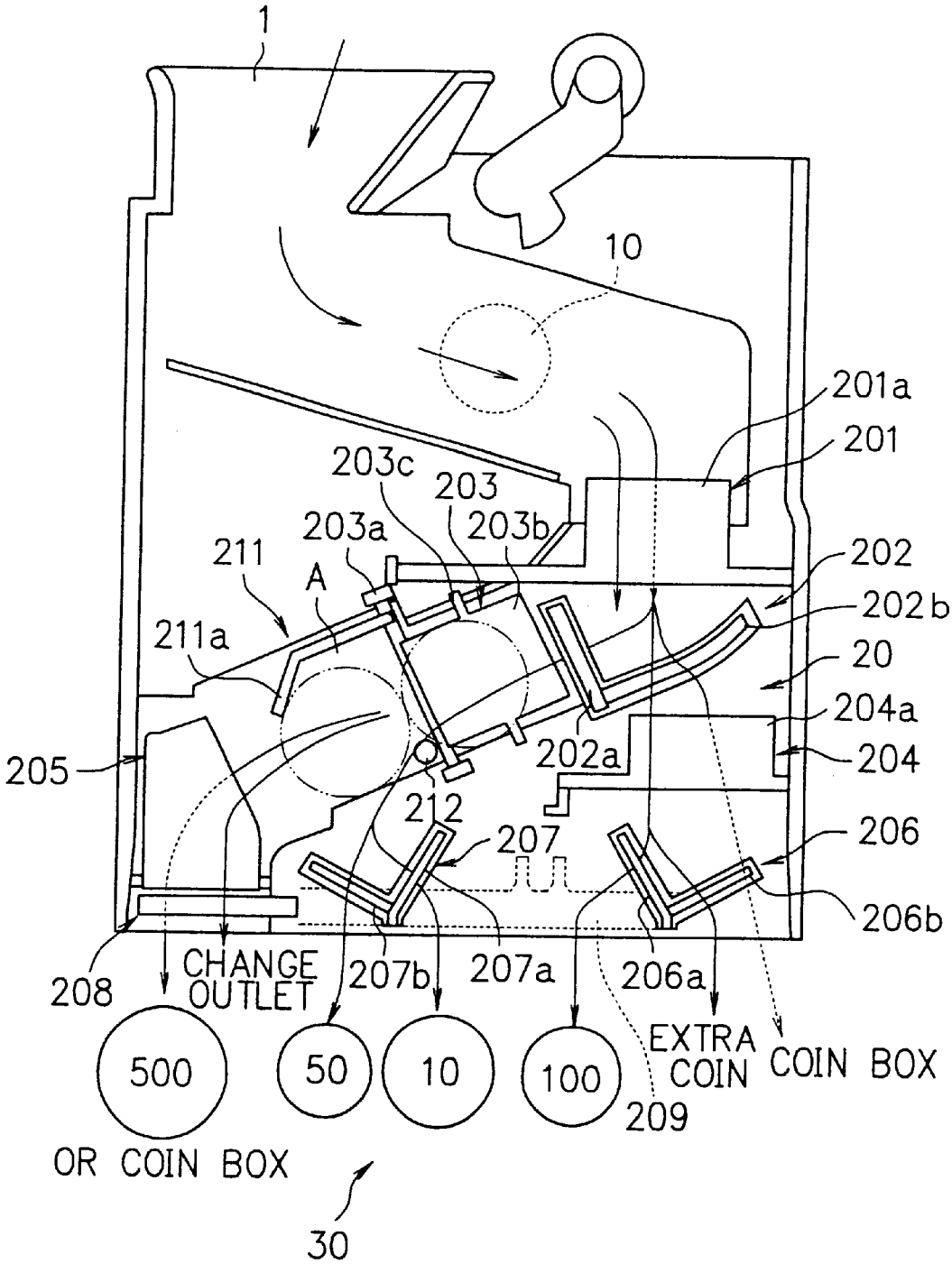
FIG. 1 is an interior structural drawing showing a coin discriminating device and a coin distributing device of a coin mechanism.

FIG. 1 to FIG. 9 are drawings showing one embodiment of a coin mechanism to which the present invention is applied.

First of all, a rough structure of the coin mechanism will be described by referring to FIG. 1 and FIG. 2. This coin mechanism is mounted on, for example, a vending machine, and it comprises: a coin discriminating device 10 for discriminating the coin inserted from the coin insert 1 (for example, the coin of ten yen, the coin of fifty yen, the coin of one hundred yen, and the coin of five hundred yen that are Japanese currency); a coin distributing device 20 for distributing the coin discriminated by the coin discriminating device 10; and a coin containing part 30 for containing the coin distributed by the coin distributing device 20, and it performs the money processing for the bought product.

The coin discriminating device 10 sends a signal of a specified frequency to the inserted coin, and on the basis of the change of the received frequency, it judges whether the inserted coin is specie or a forged coin. And furthermore, at the time of judging that the inserted coin is specie, it discriminates the kinds of the coin of one ten yen, the coin of fifty yen, the coin of one hundred yen, and the coin of five hundred yen.

The coin distributing device 20 comprises first to eighth distributing devices 201 to 208, and the first to eighth distributing devices 201 to 208 are provided in turn along the coin passage through which the inserted coin passes.

Figure 2:
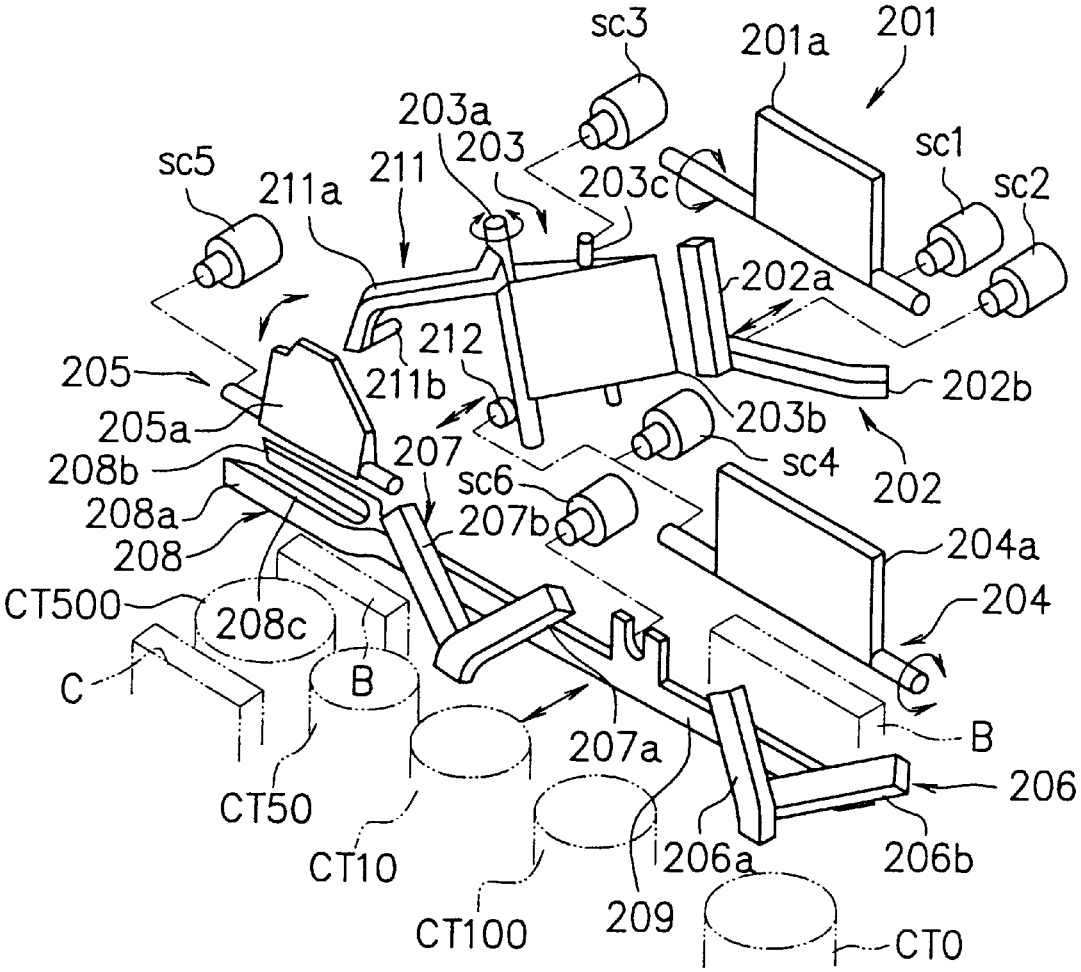
FIG. 2 is an illustration showing a structure of the coin distributing device and a coin containing part of the coin mechanism.

As shown in FIG. 1 and FIG. 2, the first distributing device 201 is a device for distributing the inserted coin to the return passage or the second distributing device 202. The device 201 works based on the judgment of the specie or the judgment of the forged coin of the inserted coin discriminated by the coin discriminating device 10. The first distributing device 201 has a rotating flapper 201*a* that can rotate, and this rotating flapper 201*a* is arranged to turn by a solenoid SC1. When the solenoid SC1 is in the non-excitation (OFF) state (when it is judged that the inserted coin is a forged coin), the inserted coin passes through the front surface of the rotating flapper 201*a,* and it is returned to the change outlet through a return passage that is not shown in the figure. On the other hand, when the solenoid SC1 is in the excitation (ON) state (when it is judged that the inserted coin is specie), the rotating flapper 201*a* rotates, and the inserted coin drops toward the second distributing device 202 through the rear side of the rotating flapper 201*a*.

Figure 3A:
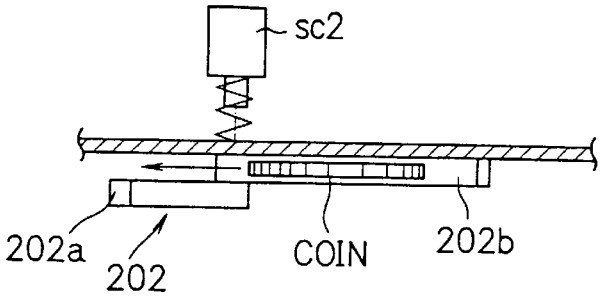
FIGS. 3A and 3B are cross sectional views showing an action of a second distributing device.
Figure 3B:
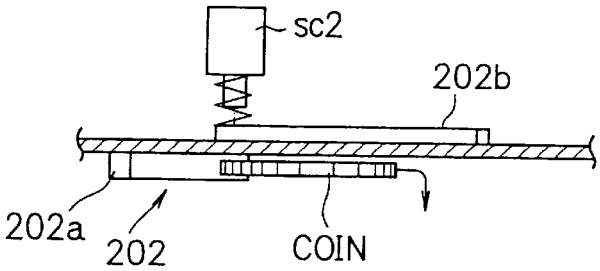

As shown in FIGS. 3A, 3B, the second distributing device 202 is a device for selecting the coin that is distributed by the first distributing device 201 to the coin of one hundred yen and other coins (the coin of ten yen, the coin of fifty yen, and the coin of five hundred yen). This second distributing device 202 has front and rear guides 202*a,* 202*b* that are branched into two ways, and the guides 202*a,* 202*b* are arranged to haunt in the coin passage A by the solenoid SC2. When this solenoid SC2 is in the non-excitation (OFF) state, as shown in FIG. 3A, the coin of ten yen, the coin of fifty yen, and the coin of five hundred yen drop on the rear side guide 202*b,* and furthermore, rolls on the guide 202*b* to move toward the third distributing device 203. On the other hand, when the solenoid SC2 is in the excitation (ON) state, as shown in FIG. 3B, the solenoid SC2 pulls the second distributing device 202 rearward. Consequently, the coin of one hundred yen drops on the front side guide 202*a,* and rolls on the guide 202*a* to move toward the fourth distributing device 204. Furthermore, in the second distributing device 202, when the coin tube CT10 for the coin of ten yen and the coin tube CT50 for the coin of fifty yen are filled, the coin of ten yen and the coin of fifty yen move toward the fourth distributing device 204.

As shown in FIG. 1 and FIG. 2, the third distributing device 203 is a device for selecting the coin distributed by the second distributing device 202 to the coin of ten yen and the coin of fifty yen, and the coin of five hundred yen. This third distributing device 203 has a rotating flapper 203*b* extending diagonally upward from the rotary shaft 203*a.* Furthermore, to a side pin 203*c* projecting near the center of the rotating flapper 203*b,* a solenoid SC3 is connected, and the rotating flapper 203*b* is arranged to turn by the solenoid SC3. Furthermore, to the rotary shaft 203*a* of this third distributing device 203, the first temporary holding device 211 is connected. The first temporary holding device 211 has a bar-shaped rotary arm 211*a* extending diagonally downward from the rotary shaft 203*a,* and has a holding projection 211*b* projecting toward the coin passage A at the tip of the rotary arm 211*a.*

Figure 8A:
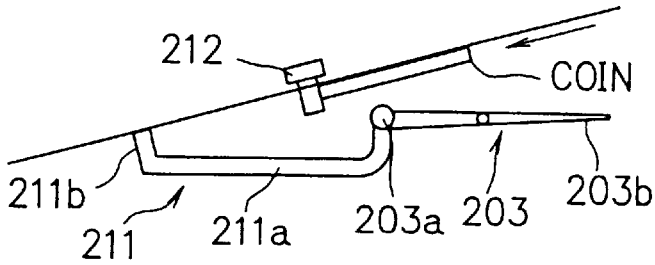
FIGS. 8A to 8D are rough explanation drawings showing a temporary holding action of one coin and a holding release action thereof.
Figure 8B:
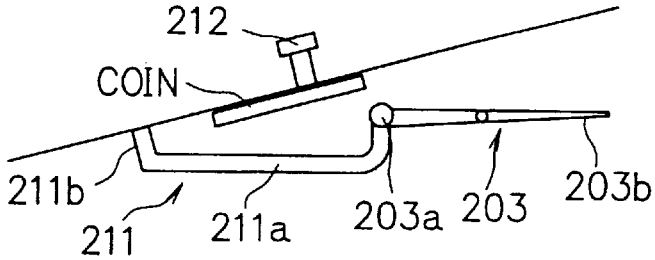
Figure 8C:
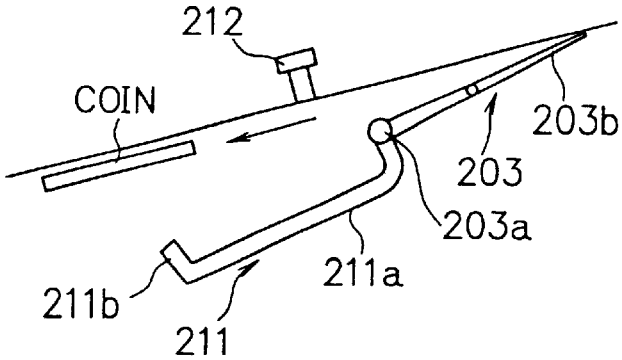

In the third distributing device, when the solenoid SC3 is in the non-excitation (OFF) state (at the time of distributing the coin of five hundred yen), the rotating flapper 203*b* is separated from the coin passage A to open the coin passage A, and in the meantime, the rotary arm 211*a* rotates toward the coin passage A. By this rotation of the rotary arm 211*a,* the tip of the holding projection 211*b* hits the coin passage A, and as shown in FIGS. 8A, 8B, it prevents the coin from passing through the coin passage A. Furthermore, when the solenoid SC3 is in the excitation (ON) state (when distributing the coins of ten yen and fifty yen), the rotating flapper 203*b* rotates toward the coin passage A to close the coin passage A, and in the meantime, the rotary arm 211*a* rotates to be separated from the coin passage A. By this rotation of the rotary arm 211*a,* the holding projection 211*b* is separated from the coin passage A, and as shown in FIG. 8C, that makes it possible for the coin to pass through the coin passage A.

Figure 8D:
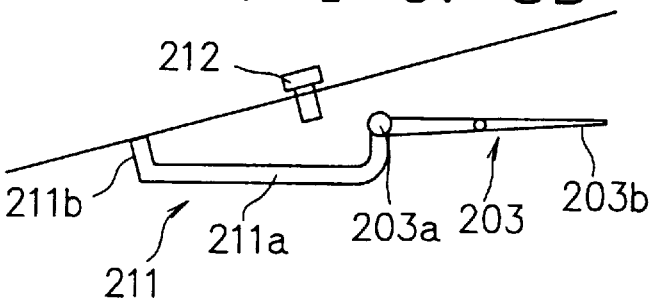

Furthermore, near the rotary shaft 203*a* in this coin passage A, the second temporary holding device 212 is provided. The second temporary holding device 212 is provided so that it may freely haunt to the coin passage A. When the solenoid SC4 is in the non-excitation (OFF) state, as shown in FIGS. 8A, 8D, this second temporary holding device 212 projects to the surface of the coin passage A from the rear side of the coin passage A to prevent the coin from passing through the coin passage A. Furthermore, when the second temporary holding device 212 is in the excitation (ON) state, as shown in FIGS. 8B, 8C, that draws back to the rear side of the coin passage A to make it possible for the coin to pass through the coin passage A.

As shown in FIG. 1 and FIG. 2, the fourth distributing device 204 is a device for distributing the coin of one hundred yen selected by the second distributing device 202 to the coin box passage B and the sixth distributing part 206. The fourth distributing device 204 has a rotating flapper 204*a* that can rotate, and this rotating flapper 204*a* is arranged to turn by the solenoid SC4 used in the above described second temporary holding device 212. When the solenoid SC4 is in the excitation (ON) state (when the coin tube CT100 for one hundred yen is filled), the rotating flapper 204*a* rotates. Consequently, the coin of one hundred yen reaching the fourth distributing device 204 is introduced to the coin box passage B through the rear side of the rotating flapper 204*a.* On the other hand, when the solenoid SC4 is in the non-excitation (OFF) state, the rotating flapper 204*a* closes the coin box passage B. Consequently, the coin of one hundred yen reaching the fourth distributing device 204 drops on the surface side of the rotating flapper 204*a,* and drops toward the sixth distributing device 206. Furthermore, when the coin of ten yen and the coin of fifty yen are distributed by the fourth distributing device 204, the solenoid SC4 is excited, and the coin of ten yen and the coin of fifty yen are introduced to the coin box passage B.

Figure 5:
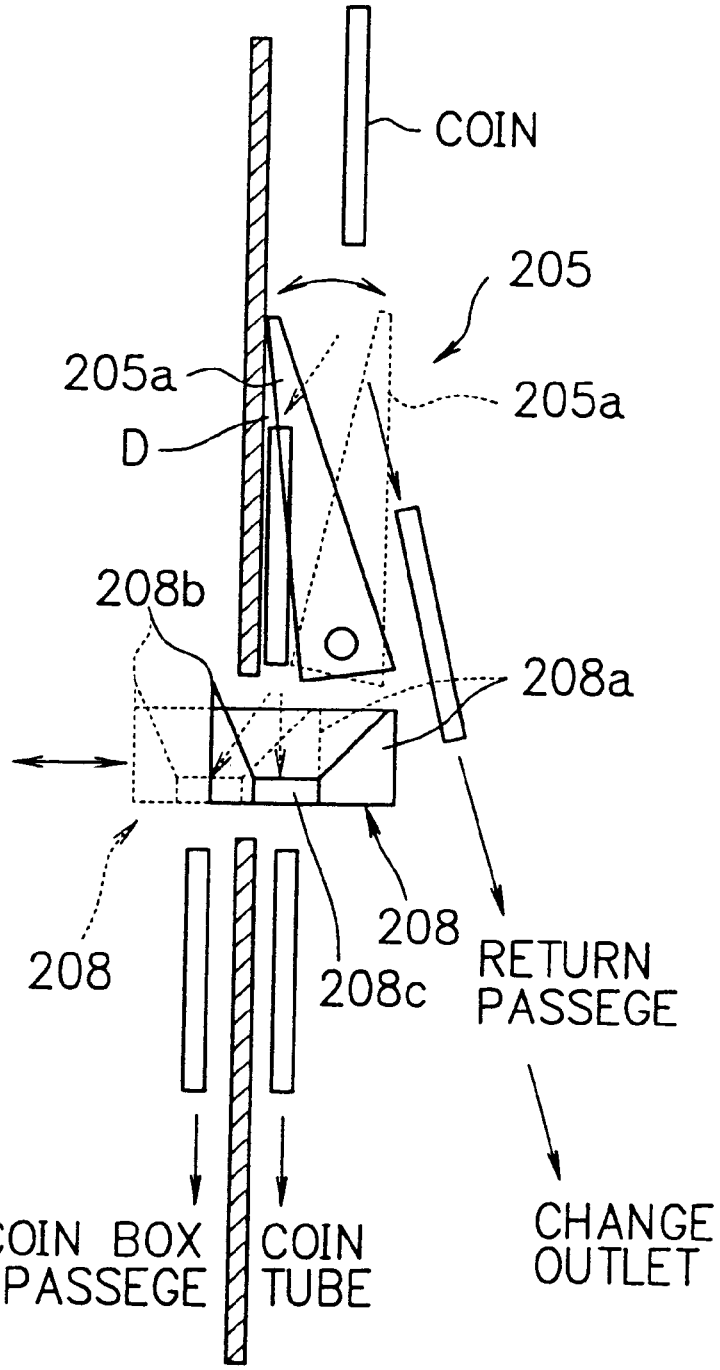
FIG. 5 is a cross sectional view showing the action of a fifth distributing device and an eighth distributing device.

The fifth distributing device is a device corresponding to the upper distributing device described in the claims. As shown in FIG. 5, the fifth distributing device 205 is a device for distributing the coin of five hundred yen passing through the third distributing device 203 and each of the temporary holding devices 211, 212 to the return passage C and the coin containing passage D. This fifth distributing device 205 has a rotating flapper 205*a* that can rotate, and this rotating flapper 205*a* is arranged to rotate by the solenoid SC5. When the solenoid SC5 is in the excitation (ON) state, the rotating flapper 205*a* rotates as shown by the solid line in FIG. 5. Consequently, the coin of five hundred yen is introduced to the return passage C as shown by the solid arrow in FIG. 5. On the other hand, when it is in the non-excitation (OFF) state, the rotating flapper 205*a* rotates to close the return passage C and in the meantime, to open the coin containing passage D as shown by the broken line in FIG. 5. Consequently, the coin of five hundred yen is introduced to the eighth distributing device 208 through the coin containing passage D.

The sixth distributing device 206, the seventh distributing device 207, and the eighth distributing device 208 are devices to be controlled by the solenoid SC6, and they are formed integrally with the connecting plate 209 connected to this solenoid SC6.

Figure 4A:
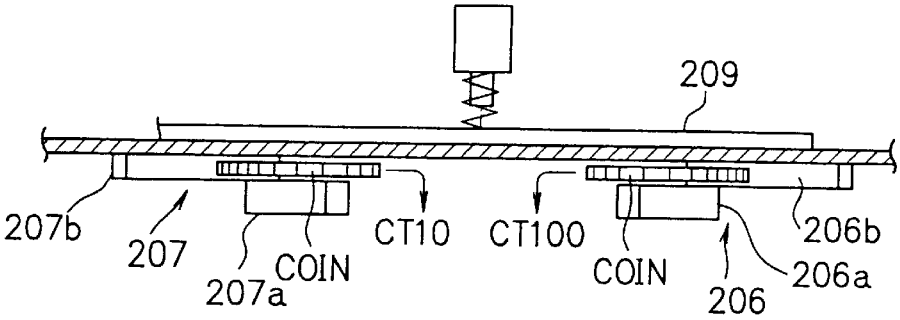
FIGS. 4A and 4B are cross sectional views showing an action of a sixth distributing device and a seventh distributing device.
Figure 4B:
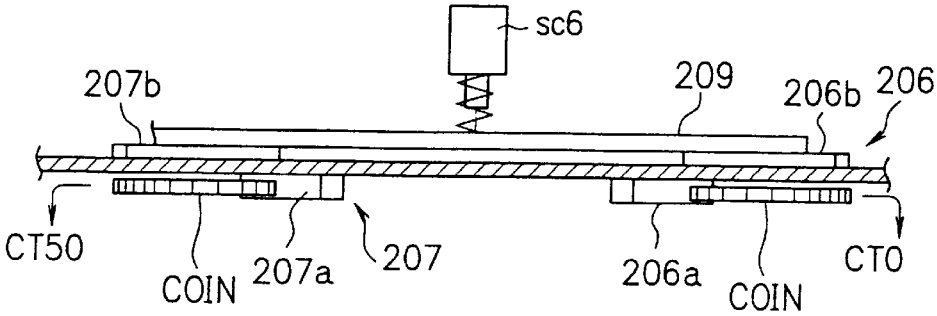

First, the sixth distributing device 206 will be described. As shown in FIGS. 4A, 4B, the sixth distributing device 206 is a device for distributing the coin of one hundred yen distributed by the fourth distributing device 204 to the coin tube CT100 for one hundred yen and the extra tube CT0. The sixth distributing device 206 has front and rear guides 206*a,* 206*b* that are branched to two ways, and the guides 206*a,* 206*b* are arranged to haunt to the coin passage A by the solenoid SC6. When this solenoid SC6 is in the non-excitation (OFF) state, as shown in FIG. 4A, the coin of one hundred yen drops on the rear side guide 206*b,* and furthermore, it rolls on the guide 206*b,* and after that, it drops to be contained in the coin tube CT100. On the other hand, when the solenoid SC6 is in the excitation (ON) state, as shown in FIG. 4B, the connecting plate 209 is drawn rearward. Consequently, the coin of one hundred yen drops on the front side guide 206*a,* and furthermore, it rolls on the guide 206*a,* and after that, it drops to be contained in the extra coin tube CT0.

The seventh distributing device 207 is a device for distributing the coins of ten yen and fifty yen distributed by the third distributing device 203 to the coin tube CT10 for ten yen and the coin tube CT50 for fifty yen. The seventh distributing device 207 has front and rear guides 207*a,* 207*b* that are branched to two ways, and the guides 207*a,* 207*b* are arranged to haunt to the coin passage A by the solenoid SC6. When this solenoid SC6 is in the non-excitation (OFF) state, as shown in FIG. 4A, the coin of one hundred yen drops on the rear side guide 207*b,* and furthermore, it rolls on the guide 207*b,* and after that, it drops to be contained in the coin tube CT10 for ten yen. On the other hand, when the solenoid SC6 is in the excitation (ON) state, as shown in FIG. 4B, the connecting plate 209 is drawn rearward. Consequently, the coin of fifty yen drops on the front side guide 207*a,* and furthermore, it rolls on the guide 207*a,* and after that, it drops to be contained in the coin tube CT50 for fifty yen.

The eighth distributing device 208 is a device corresponding to the lower distributing device described in the claims. As shown in FIG. 2 and FIG. 5, the eighth distributing device 208 is a device for distributing the coin of five hundred yen to the coin box passage B or the coin tube CT500. The eighth distributing device 208 is formed integrally with the connecting plate 209, and as shown in FIG. 2, it has forked guide walls 208*a,* 208*b* extending in parallel toward the tip. Furthermore, each of the guide walls 208*a,* 208*b* has a coin sliding surface diagonally inward, and by this coin sliding surface, the coin of five hundred yen is guided to the outlet 208*c* at the center of the bottom surface. When the solenoid SC6 is in the non-excitation (OFF) state, as shown by the solid line in FIG. 5, the outlet 208*c* is facing to the coin tube CT500 for five hundred yen, and consequently, the coin of five hundred yen is introduced to the coin tube CT500. On the other hand, when the solenoid SC6 is in the excitation (ON) state, as shown by the broken line in FIG. 5, the eighth distributing device 208 moves rearward. Consequently, the coin of five hundred yen is introduced to the rear coin box passage B.

In the coin mechanism with such a structure, as shown in FIG. 1, the forged coin is distributed by the first distributing device 201, and it is returned to the change outlet through the return passage. The inserted coin of one hundred yen is distributed to the coin box passage B, the coin tube CT100, or the extra coin tube CT0 through the first distributing device 201, the second distributing device 202, the fourth distributing device 204, and the sixth distributing device 206. The inserted coin of ten yen is distributed to the coin box passage B or the coin tube CT10 through the first to fourth distributing devices 201 to 204, and the seventh distributing device 207. The inserted coin of fifty yen is distributed to the coin box passage B or the coin tube CT50 through the first to fourth distributing devices 201 to 204, and the seventh distributing device 207.

The above described distributing action of the inserted coin is similar to that in the conventional coin mechanism, and the coin mechanism according to the present embodiment is characterized by the control when the coin of five hundred yen is inserted.

Figure 6:
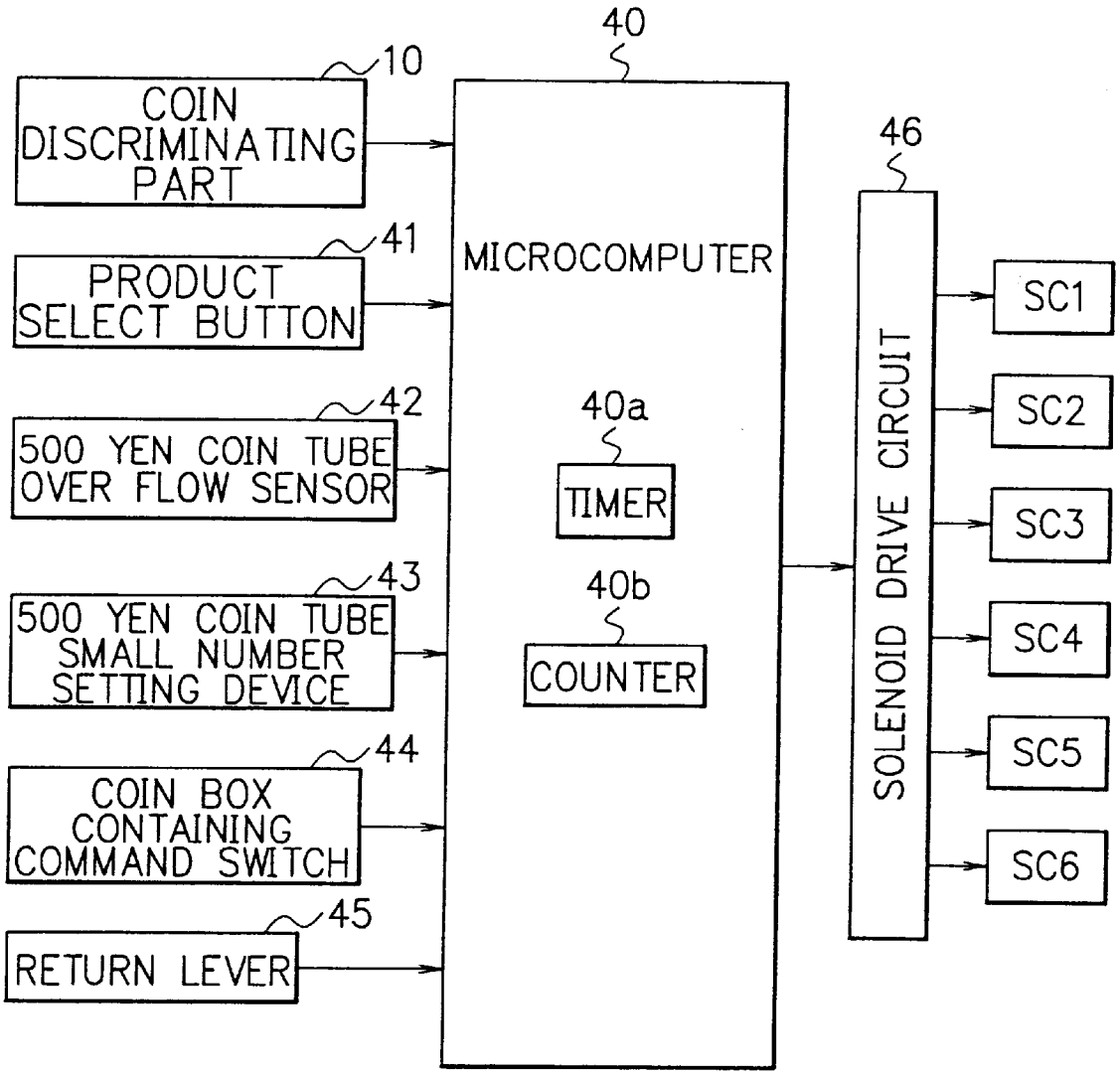
FIG. 6 is a block diagram showing a drive control circuit of the coin mechanism.
Figure 7:
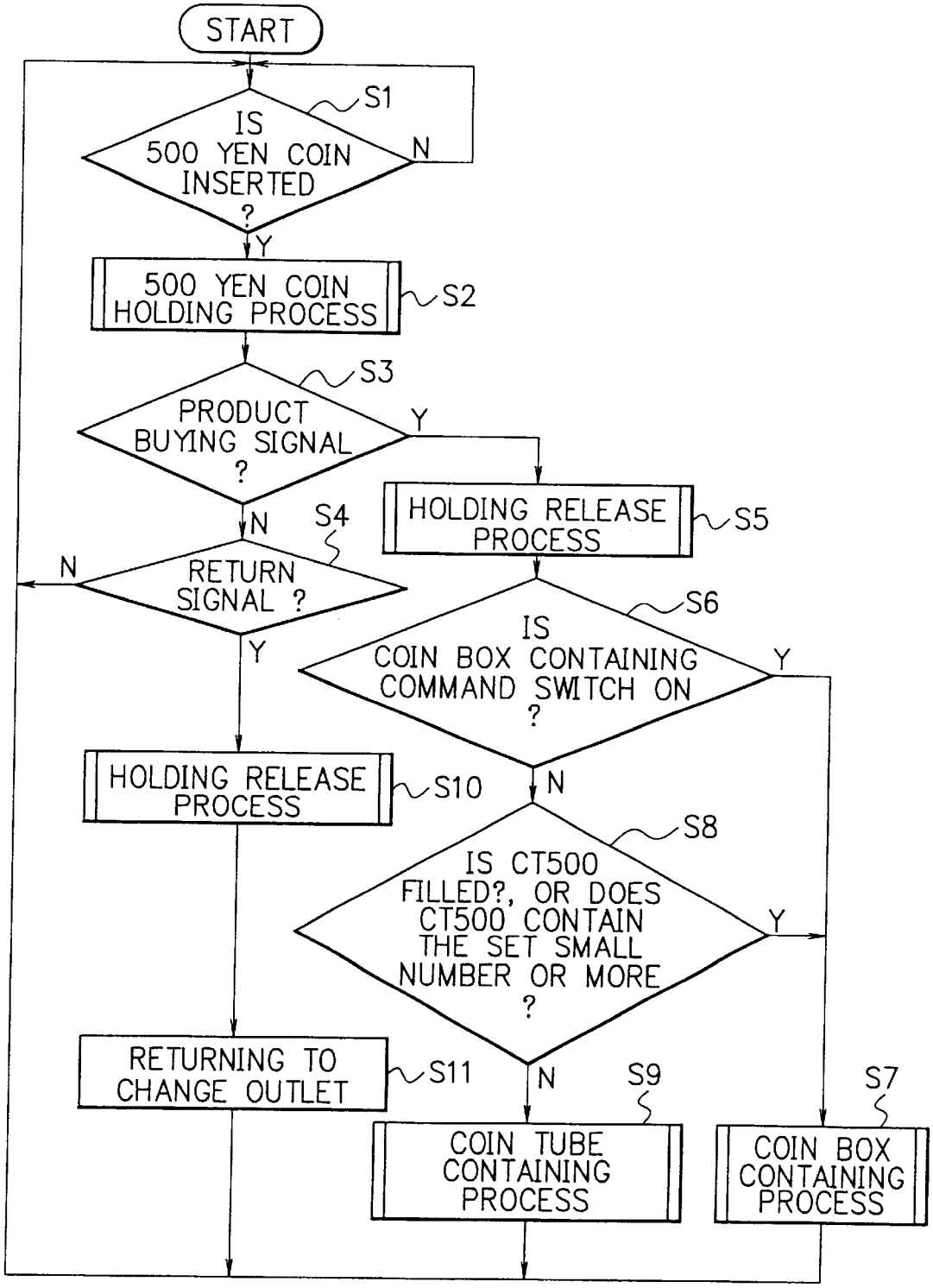
FIG. 7 is a flow chart showing a temporary holding control of the coin.

This characteristic structure according to the present embodiment will be described by referring to the block diagram in FIG. 6 and the flow chart in FIG. 7. First, the drive control circuit for controlling each of the solenoids SC1 to SC6 will be described by referring to FIG. 6. It has a microcomputer 40 as control means of the coin mechanism, and in the microcomputer 40, a timer 40*a* and a counter 40*b* are assembled. To the timer 40*a,* the excitation time at the time when each of the solenoids SC1 to SC6 is ON is set. Furthermore, the counter 40*b* is set to count the number of inserted coins such as the coin of five hundred yen.

Furthermore, to the microcomputer 40, the following signal is inputted. Whether the inserted coin is specie or a forged coin is judged, and when it is judged that the coin is a forged coin, a judgment signal of the forged coin is inputted from the coin discriminating device 10. Furthermore, when it is judged that the inserted coin is specie, which the inserted coin is among the coin of ten yen, the coin of fifty yen, the coin of one hundred yen, or the coin of five hundred yen is judged, and a judgment signal of the kind of money corresponding to the inserted coin is inputted from the coin discriminating device 10. The product select button 41 is a button to be pressed by the customer when buying a product, and when this product select button 41 is pressed, a product buying signal is inputted. The over flow sensor 42 is a sensor provided to the coin tube CT500 for five hundred yen, and when the coin tube CT500 is filled with the coins of five hundred yen contained in the coin tube CT500, an over flow signal is inputted. The setting device 43 is a setting device for setting the number of containable coins to a small number, for example, setting the number of containable coins of the coin tube CT500 to four, and from this setting device 43, a number setting signal is inputted. The switch 44 is a switch for giving a command so that all coins of five hundred yen are contained in the coin box, and a command signal of containing in the coin box is inputted from the switch 44. The return lever 45 is a lever to be operated when the customer stops the product buying operation, and when the customer operates the return lever 45, a coin return signal is inputted. The microcomputer 40 controls each of the solenoids SC1 to SC6 through the solenoid drive circuit 46 on the basis of these signals, and it performs the temporary holding action and the holding release action of the coin of five hundred yen, and furthermore, the distributing control of the coin of five hundred yen.

How the inserted coin of five hundred yen is processed will be described by referring to the flow chart in FIG. 7 and each action explanation drawing in FIGS. 8A to 8D and FIGS. 9A to 9E.

When a coin (specie) of five hundred yen is inserted (S1), the holding process of the coin of five hundred yen is performed (S2). In this holding process, the solenoid SC1 is excited for a specified time. Consequently, the rotating flapper 201*a* of the first distributing device 201 turns, and as shown by the broken line in FIG. 1, the coin of five hundred yen is introduced to the rear side of the rotating flapper 201*a*. Then, the coin of five hundred yen passing through the rotating flapper 201*a* drops to the guide 202*b* on the rear side of the second distributing device 202 as shown in FIG. 3A. Then, it rolls on the guide 202*b,* and it is introduced to the third distributing device 203 side, and as shown in FIG. 8A, it is held by the second temporary holding device 212.

Figure 9A:
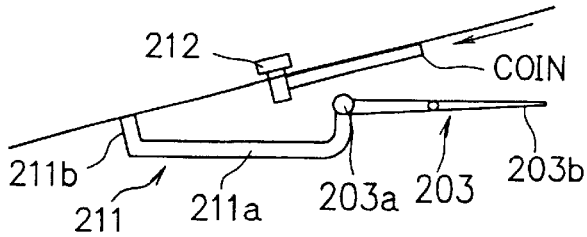
FIGS. 9A to 9E are rough explanation drawings showing a temporary holding action of two coins and a holding release action thereof.
Figure 9B:
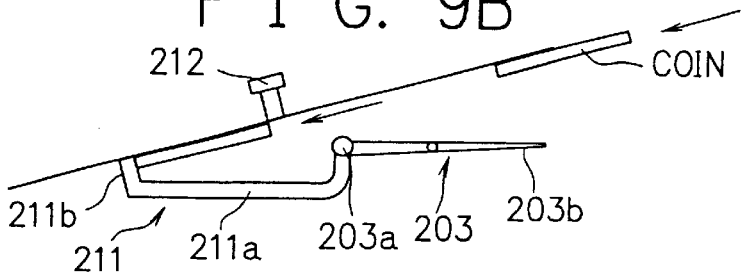
Figure 9C:
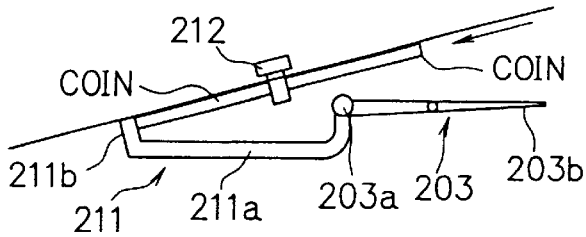

As mentioned above, while the first coin of five hundred yen is held by the second temporary holding device 212, when a second coin of five hundred yen is inserted, the solenoid SC4 is excited for a specified time, and the second temporary holding device 212 is moved to the rear side of the coin passage A. Consequently, as shown in FIG. 9B, the second temporary holding device 212 is separated from the coin passage A, and the first coin of five hundred yen shown in FIG. 9A rolls toward the first temporary holding device 211*b,* and it is held by the first temporary holding device 211*b*. Furthermore, as shown in FIG. 9C, the second coin of five hundred yen is introduced to the rear side of the third distributing device 203, and this second coin of five hundred yen is also held. Furthermore, the first coin of five hundred yen and the second coin of five hundred yen are brought into contact with each other as shown by the two dot chain line in FIG. 1, and the state is made such that the second coin is held by the first coin (second coin is not brought into contact with the second temporary holding device 212).

As mentioned above, when one coin of five hundred yen is inserted, it is temporarily held as shown in FIG. 8A, and on the other hand, when two coins of five hundred yen are inserted, they are temporarily held as shown in FIG. 9C.

While the coin of five hundred yen is held by the first or second temporary holding devices 211, 212, whether a product buying signal is inputted or not is judged, and furthermore, whether the return lever 44 is operated or not is judged. When it is judged that a product buying signal is inputted, the holding release process of the coin of five hundred yen is performed (S5). In this holding release process, first, whether the number of inserted coins of five hundred yen is one or two is judged. When the number of inserted coins is one, the solenoid SC4 is excited for a specified time, and the second temporary holding device 212 is moved to the rear side of the coin passage A. Consequently, as shown in FIG. 8B, the holding state of the coin is released, and the coin rolls toward the holding projection 211*b* of the first temporary holding device 211. Following on this excitation of the solenoid SC4, the solenoid SC3 is excited for a specified time. Consequently, as shown in FIG. 8C, the coin rolls toward the fifth distributing device 205 without being held by the holding projection 211*b*. After finishing such a series of actions, as shown in FIG. 8D, the third distributing device 203 returns to the waiting state.

Figure 9D:
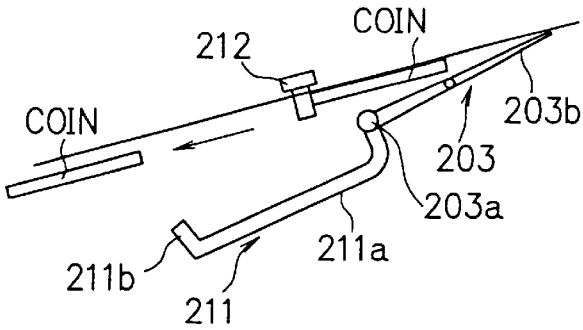
Figure 9E:
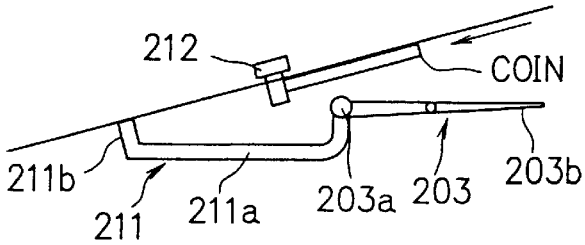

On the other hand, when the number of inserted coins of five hundred yen is two, the solenoid SC3 is excited for a specified time. Consequently, as shown in FIG. 9D, the headmost coin of five hundred yen rolls toward the fifth distributing device 205, and after that, as shown in FIG. 9E, the state is made such that one coin of five hundred yen is held. After the headmost coin of five hundred yen is carried out like this, the number of coins of five hundred yen is subtracted by one, and the memory part of the microcomputer 40 is rewritten such that the number of coins of five hundred yen is one. Furthermore, as shown in FIG. 9D and FIG. 9E, after carrying out one coin of five hundred yen, the product buying operation is continuously performed, and when the sum of buying money comes to be a sum of money exceeding five hundred yen, the holding release process shown in FIGS. 8A to 8D are performed, and the second coin of five hundred yen is also carried out to the fifth distributing device 205 side.

Following on this holding release process, whether the coin box containing switch 44 is ON or not is judged (S6). This switch 44 is a switch to be inputted when no bill varidator (not shown in the drawing) is provided and it does not occur for the coin of five hundred yen to be the change. Here, when the coin box containing switch 44 is ON, containing the coin in the coin tube CT500 is unnecessary, and therefore, the coin box containing process is performed (S7). In this coin box containing process, the solenoids SC5, SC6 are excited for a specified time. Consequently, as shown by the broken line in FIG. 5, the fifth distributing device 205 and the eighth distributing device 208 are operated, and the coins of five hundred yen pass through the coin containing passage D, and furthermore, all are contained in the coin box through the coin box passage B.

Following on this judgment of ON or OFF of the coin box containing switch 44, whether there is a coin containing prohibition command to the coin tube or not is judged (S8). This coin containing prohibition command is outputted when the coin tube CT500 is filled on the basis of a detection signal of the over flow sensor 42, and furthermore, it is outputted when the number of coins contained in the coin tube CT500 exceeds the set number of the setting device 43. Furthermore, it is arranged to set either the over flow sensor 42 or the setting device 43. That is, in the case where the coin tube CT500 is made to function effectively as a cylinder of the change, a signal from the over flow sensor 42 is received, and on the other hand, in the case where it is arranged to prevent a lot of coins of five hundred yen from being stolen from the coin tube CT500, a signal from the setting device 43 is received. When a signal is inputted in the microcomputer from either the over flow sensor 42 or the setting device 43, the containing of coins of five hundred yen to the coin tube CT500 is controlled, and the above described coin box containing process is performed (S7). When no signal is inputted from both of the over flow sensor 42 and the setting device 43, the coin of five hundred yen is contained in the coin tube CT500 as usual (S9). In this coin tube containing process, only the solenoid SC5 is excited for a specified time, and the coin of five hundred is contained in the coin tube CT500 through the coin containing passage D.

Next, the processing of the coin in the case where the customer operates the return lever 44 while the coin of five hundred yen is held will be described. When the customer operates the return lever 44 (S4), the above described holding release process is performed (S10). Consequently, the coin of five hundred yen is carried out to the fifth distributing device 205 side. Then, the solenoid SC5 of the fifth distributing device 205 and the solenoid SC6 of the eighth distributing device 208 are made in the excitation (ON) state, and as shown by the solid line in FIG. 5, the coin of five hundred yen is returned to the change outlet through the return passage C (S11).

As mentioned above, by the coin mechanism according to the present embodiment, the coin of five hundred yen whose holding has been released is distributed to the change outlet, the coin box, or the coin tube CT500 at the front stage of entering the coin containing part, and therefore, it is unnecessary to provide another distributing device in the coin tube like the prior art, and the number of coins to be contained in the coin tube CT500 is increased.

Furthermore, on the basis of the number setting signal outputted from the setting device 43, the number of coins to be contained in the coin tube CT500 can be set to a small number.

Furthermore, in the case where the coin mechanism according to the present embodiment is mounted to a vending machine having no bill varidator mounted or the like, it is possible to contain all inserted coins of five hundred yen in the coin box by turning ON the coin box containing command switch 44.

Furthermore, it is also possible that the microcomputer 40 judges whether a bill varidator is mounted or not, and the eighth distributing device 208 is controlled on the basis of this judgment signal, and all coins of five hundred yen are contained in the coin box, instead of the coin box containing command switch 44.

Furthermore, in the above described embodiment, the description has been given supposing that the inserted coin is the coin of ten yen, the coin of fifty yen, the coin of one hundred yen, or the coin of five hundred yen that is Japanese currency, but it can similarly be applied in the coin mechanism for processing the currency of various countries, for example, the coin of five cents, the coin of ten cents, the coin of twenty-five cents, the coin of fifty cents, or the coin of one dollar that is American currency.

What is claimed is:

1. A coin mechanism of a vending machine, comprising:

a coin discriminating device for discriminating the kind of a inserted coin;

temporary holding devices for temporarily holding a specified coin on a coin passage among coins discriminated by said coin discriminating device;

distributing devices for distributing the coin held by said temporary holding devices to a coin containing part or a change outlet; and control means for controlling said temporary holding devices and said distributing devices, wherein said distributing devices include an upper distributing device for distributing the coin to a change outlet or a coin containing passage communicating with said coin containing part, and a lower distributing device for distributing the coin distributed to said coin containing passage to a coin tube or a coin box, and said control means can control said upper distributing device so that the inserted coin is distributed toward said change outlet when a coin return command is given and can control said upper distributing device so that the inserted coin is distributed toward said coin containing passage when a product buying command is given, and furthermore, said control means can normally control said lower distributing device so that the inserted coin is distributed toward said coin tube and can control said lower distributing device so that the inserted coin is distributed toward said coin box when a containing prohibition command to said coin tube is given.

2. The coin mechanism according to claim 1, wherein said specified coin is a coin of the largest amount of money among the inserted coins.

3. The coin mechanism according to claim 2, further comprising said coin box containing command switch, wherein said control means can control said lower distributing device so that the inserted coin is distributed toward the coin box on the basis of a containing command signal from said coin box containing command switch.

4. The coin mechanism according to claim 2, wherein said control means can perform the control so that said lower distributing device distributes the coin toward the coin box when a bill varidator is mounted.

5. The coin mechanism according to claim 1, further comprising said coin box containing command switch, wherein said control means can control said lower distributing device so that the inserted coin is distributed toward the coin box on the basis of a containing command signal from said coin box containing command switch.

6. The coin mechanism according to claim 1, wherein said control means can perform the control so that said lower distributing device distributes the coin toward the coin box when a bill varidator is mounted.

* * * * *